US006208823B1

(12) United States Patent
Knott

(10) Patent No.: US 6,208,823 B1
(45) Date of Patent: Mar. 27, 2001

(54) DEVELOPER STATION WITH CROSS CONVEYANCE

(75) Inventor: Joseph Knott, Tutzing (DE)

(73) Assignee: Oce' Printing Systems GmbH, Poing (DE)

( * ) Notice: Subject to any disclaimer, the term of this patent is extended or adjusted under 35 U.S.C. 154(b) by 0 days.

(21) Appl. No.: 09/367,119

(22) PCT Filed: Feb. 12, 1998

(86) PCT No.: PCT/DE98/00431

§ 371 Date: Aug. 10, 1999

§ 102(e) Date: Aug. 10, 1999

(87) PCT Pub. No.: WO98/36328

PCT Pub. Date: Aug. 20, 1998

(30) Foreign Application Priority Data

Feb. 12, 1997 (DE) ..... 197 05 375

(51) Int. Cl.[7] ..... G03G 15/08
(52) U.S. Cl. ..... 399/260; 222/DIG. 1
(58) Field of Search ..... 399/254, 256, 399/258, 260; 222/DIG. 1

(56) References Cited

U.S. PATENT DOCUMENTS 3,180,313 * 4/1965 Eisner ..... 399/61
4,558,659 12/1985 Alden .
4,935,783 6/1990 Fujisawa .
5,139,176 * 8/1992 Reindl et al. ..... 222/238
5,345,298 9/1994 Corrigan, Jr. .

FOREIGN PATENT DOCUMENTS 32 25 870 1/1984 (DE) .
0 374 920 6/1990 (EP) .
0 652 493 5/1995 (EP) .
59-100472 * 6/1984 (JP) .
WO 89/08284 9/1989 (WO) .

OTHER PUBLICATIONS

Japanese Abstract, 59–100472, Jun. 9, 1984.
Japanese Abstract, 4–365073, Dec. 17, 1992.

* cited by examiner

*Primary Examiner*—Joan Pendegrass
(74) *Attorney, Agent, or Firm*—Hill & Simpson

(57) ABSTRACT

A printer or copier has a developer station with a toner dispenser in which the toner is fed from a toner box to a transverse transport above a dosing apparatus. The transverse transport includes a helix driven by a drive mechanism. The helix has a pitch H that varies along its length or a thickness D that varies along its length so that the speed of conveyance in the transverse direction decreases over the conveyance path. The rotational speed of the helix is variable by adjustment of the effective length of a drive arm or an extent of an eccentric.

20 Claims, 2 Drawing Sheets

Fig.3
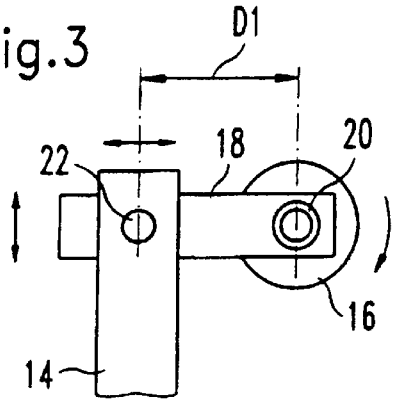
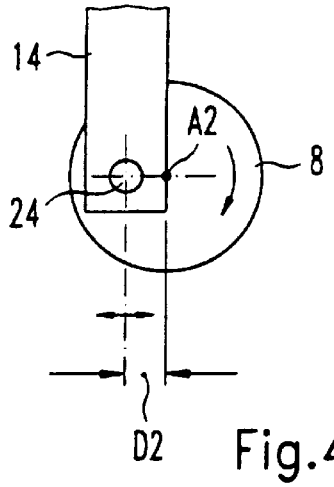
Fig.4
Fig.5
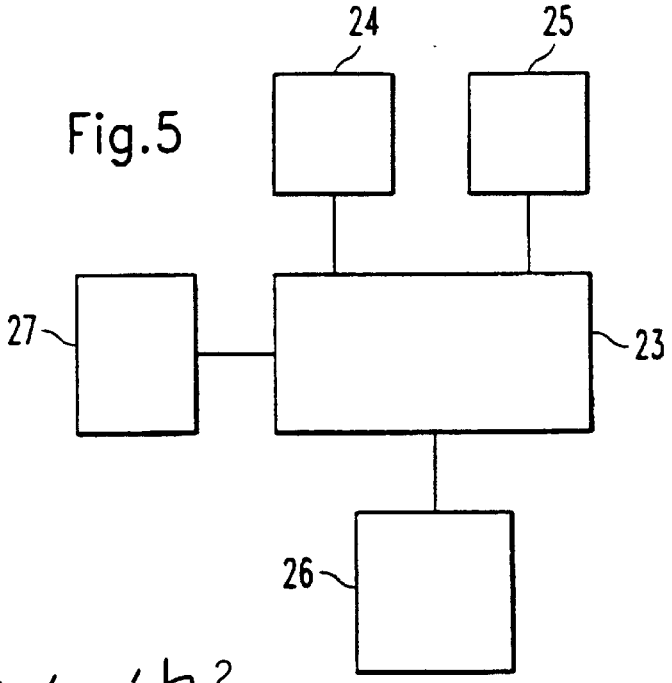
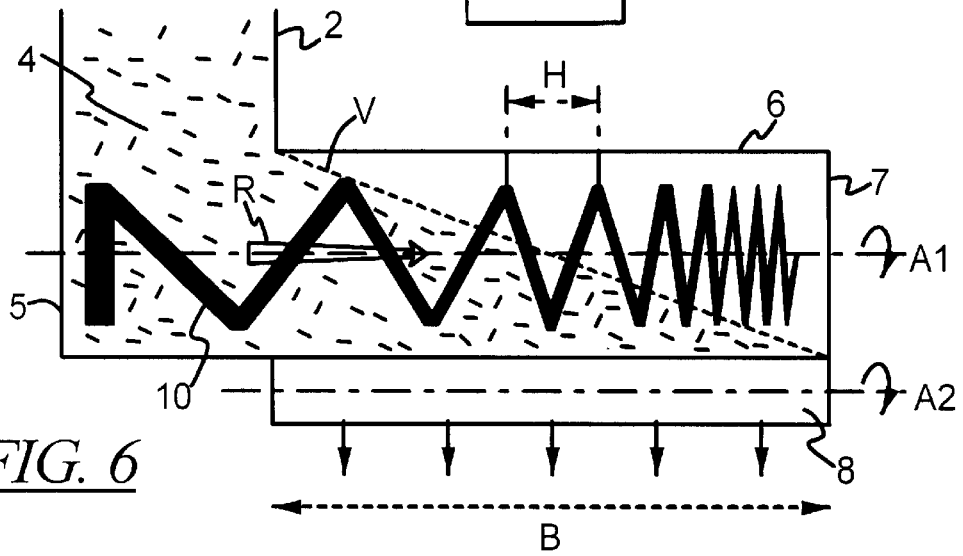
FIG. 6

DEVELOPER STATION WITH CROSS CONVEYANCE

BACKGROUND OF THE INVENTION

1. Field of the Invention

The present invention relates, generally to a printer or copier toner station and in particular to a developer station with a cross-conveyance means and a dosing means which is supplied by an intermediate receptacle, whereby a toner box opens into the intermediate receptacle at a first end of the receptacle, and toner in the intermediate receptacle is conveyed via a conveyance path across the entire printing width from the first end of the intermediate receptacle to a second end in a direction of conveyance transverse to the direction of displacement of a carrier material that is provided with toner, and, dosed by of the dosing means, the toner is released onto the carrier material.

2. Description of the Related Art

In high-speed printers which print over 10 pages per minute, developer stations which process a mixture of toner and carrier particles are usually used. While the toner is conveyed onto the material to be printed, the carrier particles remain in the developer station. In these developer stations, it is necessary to feed fresh toner to the developer mixture during the print operation. This type of developer station with toner dosing is described in U.S. Pat. No. 4,935,783, for example.

In developer stations with integrated toner cross-conveyance and toner dosing, care must be taken in the cross-conveyance of the toner to enable a uniform feeding of toner over the entire printing width of the carrier material that is to be supplied with toner. Since the different toner types differ in their transport behavior, particularly in the ratio of the toner cross-conveyance amount and the toner dosing amount, complications can arise in the toner feed in a developer station with specified conveying means and dosing means. Namely, a strong setting of the toner on the toner conveyance path, or on the other hand a toner depletion, can arise on the conveyance path, which extends over the entire printing width. Both a toner compacting of the and a toner depletion result in flaws in the printed image. A multiple toner compacting leads to toner contamination due to toner lumps, a toner depletion leads to an uneven coloration of the carrier material.

The Japanese patent document reference JP 59-100472 A teaches a means for the cross-conveyance of toner. Japanese patent document JP 4-365073 A teaches a developer station in which the ratio between the rotation speed of a developer drum and the toner conveyance speed in a toner transport means can be modified.

SUMMARY OF THE INVENTION

The present invention is based on the object of avoiding a toner compacting or a toner depletion during the toner feed in a developer station with cross-conveyance and of achieving a relatively constant ratio of the toner cross-conveyance amount and toner dosing.

This and other objects are achieved by a developer station of the abovementioned type, wherein the ratio between the amount of toner that is conveyed in the transverse direction per unit of time and the amount of toner that is released in a dosed manner per unit of time can be adjusted. A toner distribution is thereby generated in the intermediate receptacle for the toner cross-conveyance in which the amount of toner diminishes from the beginning of the toner conveyance path to the end of the toner conveyance path, and a toner compacting or toner depletion is avoided. The adjustment can occur by means of a mechanical interactive connection between elements for the cross-conveyance and elements for the dosing or by a corresponding electronic controlling of corresponding elements.

In a preferred exemplifying embodiment of the invention, the cross-conveyance means is so designed that the cross-conveyance speed of the toner decreases over the conveyance path extending from the toner box in the transverse direction. This reduces the danger of a toner backup in the frontal region of the intermediate receptacle and the danger of a toner depletion in the rear region of the intermediate receptacle.

A toner distribution is thus generated in the intermediate receptacle for the toner cross-conveyance wherein the amount of toner diminishes from the start of the toner conveyance path to the end of the toner conveyance path, and a toner compacting or toner depletion is prevented, while the danger of a toner backup in the frontal region of the intermediate receptacle and the danger of a toner depletion in the rear region of the intermediate receptacle are simultaneously reduced.

The cross-conveyance means is preferably a toner conveyor helix which is driven by a driver, and the dosing means is preferably a toner dosing shaft which is driven by a connecting rod, whereby the cross-conveyance means and the dosing means are coupled with one another via a driver lever arm and a joint in particular.

In another preferred development, the cross-conveyance means is implemented as a toner conveyor helix which is driven by a driver and whose pitch decreases over the conveyance path, which extends transversely from the toner box. Alternatively, the toner conveyance helix can be fashioned such that its thickness decreases over the conveyance path, which extends transversely from the toner box. As the distance from the first end, i.e. from the front part of the intermediate receptacle, increases, the conveying power of the toner conveyor helix toward the other end, i.e. to the rear part of the intermediate receptacle, decreases.

In another preferred development of the invention, the cross-conveyance means is a toner conveyance helix which is driven by a driver, the pitch and/or thickness of which helix decreases over the conveyance path extending transversely from the toner box. This enables even more constructional freedom in the designing of the toner conveyor helix and even greater reliability in the transverse transport of the toner.

In one specific development, the cross-conveyance means is a toner conveyance helix that is driven by a driver, and the dosing means is a toner dosing shaft that is driven by a connecting rod, whereby the cross-conveyance means and the dosing means are coupled with one another via a driver lever arm and a joint, in particular. This mechanical driving of the toner conveyance helix and the dosing means is uncomplicated and enables their simple mechanical coupling.

The ratio of the amount of toner that is conveyed transversely per unit of time and the amount of toner that is released in a dosed manner per unit of time can be advantageously adjusted by means of an adjustable lever arm length of the driver lever arm and/or an adjustable eccentric lift of the connecting rod. The ratio between the toner cross-conveyance amount and the toner dosing amount can thereby be held constant regardless of the toner type, in order to guarantee a uniform toner feed over the entire printing width. The lever arm length and/or the eccentric lift can be adjustable in a stepped or stepless manner, as required.

BRIEF DESCRIPTION OF THE DRAWINGS

Other advantages, features and application possibilities of the present invention emerge from the following description of preferred exemplifying embodiments with the aid of the drawings.

FIG. 3 and FIG. 4 are side view which depict elements for the mechanical coupling of the cross-conveyance means with the dosing means, and FIG. 5 is a functional block diagram which depicts elements for the electronic coupling of the cross-conveyance means with the dosing means, FIG. 6 is a side cross section of a toner conveying helix of varying pitch and thickness.

DETAILED DESCRIPTION OF THE PREFERRED EMBODIMENTS

Figure 1:
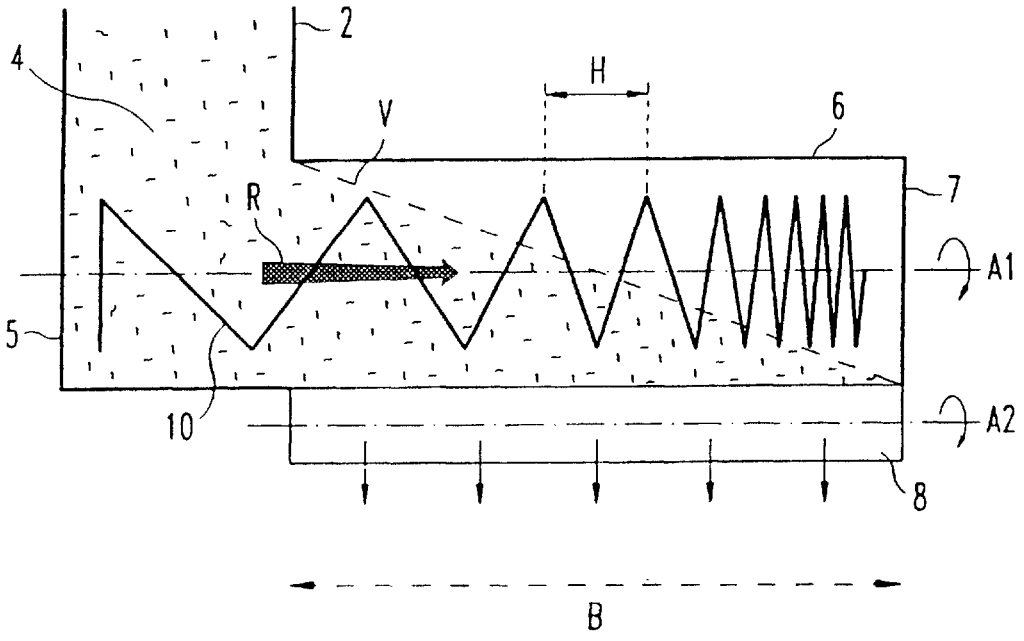
FIG. 1 is a schematic illustration in side view which depicts components of a first developer station with a toner conveyance helix whose pitch varies.

FIG. 1 depicts a first exemplifying embodiment of the present invention. The illustrated mechanism serves for purposes of the cross-conveyance of toner 4 across the entire printing width B of a carrier material (not illustrated) that is to be supplied with toner 4. The toner box 2 is connected to the intermediate receptacle 6 at a first end 5 of the intermediate receptacle 6. The intermediate receptacle 6 extends from the first end 5 to a second end 7 essentially transversely to the conveyance direction of the carrier material. It contains a mixture of toner and carrier particles. A toner conveyance helix 10 extends in the interior of the intermediate receptacle 6 between its two ends 5 and 7 and is mounted such that it can be rotated about its longitudinal axis A1 extending between the two ends 5 and 7 of the intermediate receptacle 6. The pitch H of the toner conveyance helix 10 decreases from the first end 5 of the intermediate receptacle 6 to the second end 7 of the intermediate receptacle 6. At the bottom of the intermediate receptacle 6, there is a toner dosing shaft 8 which is mounted such that it can be rotated about its longitudinal axis A2.

To convey the toner 4 through the intermediate receptacle 6 transversely in the direction of the arrow R, the toner conveyance helix 10 is rotated about its longitudinal axis A1, thereby pushing the toner from the first end 5 of the intermediate receptacle 6 is to the second end 7 of the intermediate receptacle 6. Since the pitch H of the toner conveyance helix 10 decreases along the conveyance direction R, the cross-conveyance speed also decreases over the conveyance path from the first end 5 of the intermediate receptacle 6 to the second end 7. In this way, a toner distribution V in the intermediate receptacle 6 is achieved wherein the amount of toner 4 that is available in the intermediate receptacle 6 decreases from the first end 5 of the intermediate receptacle 6 to the second end 7. The danger of a toner backup is thereby reduced, while a toner depletion in the region of the second end 7 of the intermediate receptacle 6 is simultaneously prevented.

Figure 2:
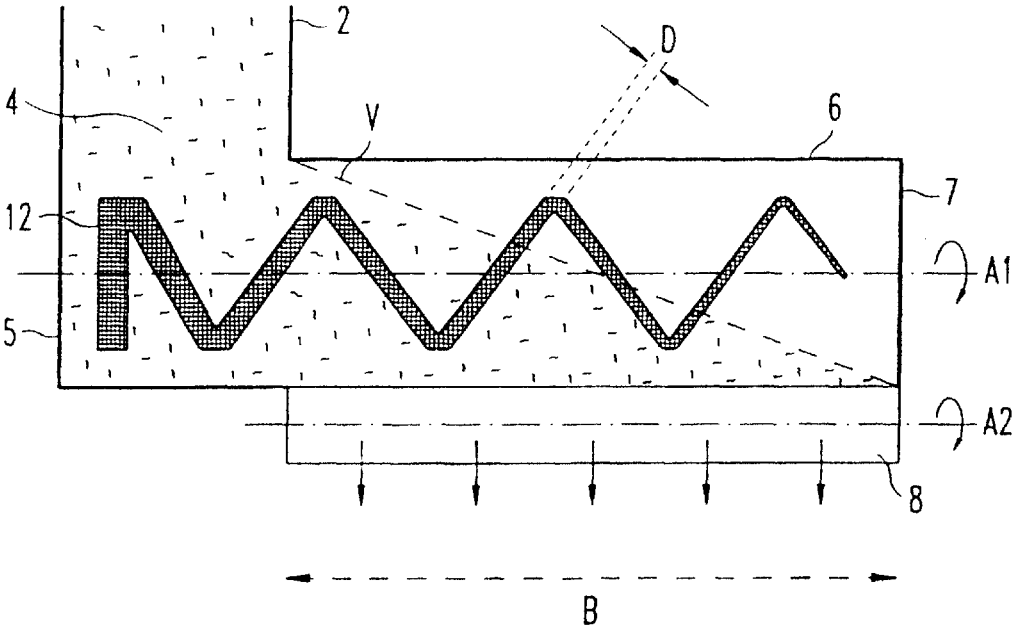
FIG. 2 is a schematic side view which depicts components of a second developer station with a toner conveyance helix whose thickness varies.

FIG. 2 depicts a second exemplifying embodiment of the invention. A mechanism for the cross-conveyance of toner 4 is illustrated here as well. Elements which are identical to elements in FIG. 1 carry the same reference characters as in FIG. 1. Instead of the toner conveyance helix 10 from FIG. 1, in this exemplifying embodiment a toner conveyance helix 12 extends between the first end 5 and the second end 7 of the intermediate receptacle, whose thickness D decreases from the first end 5 of the intermediate receptacle 6 to the second end 7. The effect of this decreasing thickness D of the toner conveyance helix 10 is similar to the decreasing pitch H of the toner conveyance helix 10 from FIG. 1. It assures a decreasing cross-conveyance speed from the first end 5 to the second end 7. Here as well, a toner distribution V in the intermediate receptacle 6 is achieved which decreases from the first end 5 to the second end 7 of the intermediate receptacle 6. The achieved effect is as in the first exemplifying embodiment according to FIG. 1.

The FIGS. 3 and 4 depict components of a mechanism for the mechanical coupling of the cross-conveyance means with the dosing means (see FIG. 1, FIG. 2). The upper part (FIG. 3) and the lower part (FIG. 4) of the coupling means are connected via a connecting rod 14. The connecting rod 14 is connected to the lower part by a joint 22 and to the lower part by a joint 24. The upper part has a driver 16 for driving the toner conveyor helix 10 or 12 according to FIG. 1, or respectively, FIG. 2, which is linked via a driver lever arm 18 at the upper part of the connecting rod 14. The driver 16 is mounted at the lever arm 18 by a free-wheel 20. The bottom part is formed by the toner dosing shaft 8, which is driven eccentrically with reference to the its rotational axis A2 by the bottom part of the connecting rod 14 with the aid of the joint 24. The ratio between the amount of toner 4 that is conveyed transversely per unit of time and the amount of toner 4 that is released in a dosed manner per unit of time can be adjusted by adjusting the lever arm length D1 and the driver arm 18 and/or by adjusting the eccentric lift D2 of the connecting rod. The driver 16 serves to drive the toner conveyor helix 10 (FIG. 1), or respectively, the toner conveyor helix 12 (FIG. 2). The adjustment of the lever arm length D1 and of the eccentric lift D2 can occur in a stepped or stepless manner.

FIG. 5 depicts an electronic control unit 23 with which an interactive connecting (coupling) between elements for cross-conveyance of the toner and elements for dosing of the toner can occur. To this end, it is connected to a drive motor 24 for cross-conveyance of the toner and to a motor 25 for dosing of the toner. The control unit 23 obtains signals about the type of toner from an input station 26. If these signals comprise characteristic data about the density of the toner and/or about the grain size of the toner, for example, then the control unit 23 computes a suitable cross-conveyance speed and/or dosing amount and controls the motors 24 and 25 accordingly. For specific predefined standard toners, the control unit 23 derives appropriate cross-conveyance and dosing values directly from a preallocated memory 27.

The input station 26 can be configured such that it is served by an operator, such as a menu-driven operating field, or is connected to a sensor which detects the type of toner that is present in the toner box.

Although other modifications and changes may be suggested by those skilled in the art, it is the intention of the inventors to embody within the patent warranted hereon all changes and modifications as reasonably and properly come within the scope of their contribution to the art.

FIG. 6 shows an embodiment of the conveying helix 10 comparable to FIG. 1 except that the thickness of the helix wire varies along its length.

What is claimed is:

1. A developer station, comprising:

a cross-conveyance apparatus constructed to convey toner in a conveying direction, a dosing apparatus disposed to receive the toner conveyed by said cross-conveyance apparatus, an intermediate receptacle having first and second ends, said intermediate receptacle supplying toner to said dosing apparatus, a toner box that opens into the intermediate receptacle at said first end of said intermediate receptacle, and said cross-conveyance apparatus conveying toner in the intermediate receptacle via a conveyance path over an entire printing width from the first end of the intermediate receptacle to the second end in the conveying direction transverse to a displacement direction of a carrier material that is to be provided with toner and is released onto the carrier material in a dosed manner by said dosing apparatus, a ratio of an amount of the toner that is conveyed transversely per unit of time relative to the amount of the toner that is released in a dosed manner per unit of time being adjustable.

2. A developer station according to claim 1, wherein said cross-conveyance apparatus is constructed so that a cross-conveyance speed of the toner decreases over the conveyance path extending from the toner box transversely.

3. A developer station according to claim 1, wherein said cross-conveyance apparatus includes a toner conveyor helix that is driven by a driver.

4. A developer station according to claim 3, wherein the toner conveyor helix has a pitch that decreases over the conveyance path extending from the toner box transversely.

5. A developer station according to claim 3, wherein the toner conveyor helix has a thickness that decreases over the conveyance path extending from the toner box transversely.

6. A developer station according to claim 1, in which the pitch and the thickness of the toner conveyor helix decrease over the conveyance path extending from the toner box transversely.

7. A developer station according to claim 1, wherein said dosing apparatus includes a toner dosing shaft that is driven by a connecting rod.

8. A developer station according to claim 7, further comprising:

a driver lever arm and a joint connecting said cross-conveyance apparatus and said dosing apparatus.

9. A developer station according to claim 8, wherein said driver lever arm is adjustable in effective length so that a ratio of an amount of toner that is conveyed transversely per unit of time and an amount of toner that is released in a dosed manner per unit of time can be adjusted by adjustment of a lever arm length of the driver lever arm.

10. A developer station according to claim 9, wherein the lever arm length is adjustable in a stepless manner.

11. A developer station according to claim 9, wherein the lever arm length is adjustable in a stepped manner.

12. A developer station according to claim 1, further comprising:

a mechanical interactive connection between the cross-conveyance apparatus and the dosing apparatus.

13. A developer station according to claim 1, further comprising:

an electronic interactive connection between the cross-conveyance apparatus and the dosing apparatus.

14. A developer station according to claim 13, further comprising:

an electronic control which receives signals from an input station about a type of toner and which forms control signals from said signals for cross-conveying the toner and for toner dosing.

15. A developer station according to claim 1, wherein the intermediate receptacle contains a developer mixture of toner and carrier particles.

16. A developer station according to claim 7, wherein said connecting rod is adjustable in eccentric lift so that a ratio of an amount of toner that is conveyed transversely per unit of time and an amount of toner that is released in a dosed manner per unit of time can be adjusted.

17. A developer station according to claim 16, wherein the eccentric lift can be adjusted in a stepless manner.

18. A developer station according to claim 16, wherein the the eccentric lift can be adjusted in a stepped manner.

19. A method for conveying toner from a toner box to a dosing apparatus, comprising the steps of:

conveying toner from a first end of an intermediate receptacle at which the toner is received from said toner box to a second end of said intermediate receptacle over said dosing apparatus; and adjusting a ratio of a quantity of the toner conveyed per unit of time and relative to a quantity of toner released in a dosed manner by said dosing apparatus.

20. A method as claimed in claim 19, wherein said conveying step conveys the toner with a conveying speed that decreases over an extent of conveyance.

* * * * *